United States Patent [19]

Barber et al.

[11] 3,958,085

[45] May 18, 1976

[54] COMPATIBLE 4-2-4 ENCODING-DECODING SYSTEM

[75] Inventors: Ronald O. Barber; Daniel J. Barnes, both of Fort Wayne, Ind.

[73] Assignee: The Magnavox Company, Fort Wayne, Ind.

[22] Filed: May 6, 1974

[21] Appl. No.: 467,357

Related U.S. Application Data

[63] Continuation of Ser. No. 181,847, Sept. 20, 1971, abandoned.

[52] U.S. Cl. ..... 179/1 GQ; 179/100.4 ST

[51] Int. Cl.[2] ..... H04R 5/00

[58] Field of Search ..... 179/16 Q, 100.4 ST

[56] References Cited

UNITED STATES PATENTS 3,697,692 10/1972 Hafler ..... 179/1 GQ 3,813,494 5/1974 Bauer ..... 179/1 GQ

OTHER PUBLICATIONS

Dyna Quadriphonics, Type II High Fidelity Magazine Feb. 1971 pp. 26, 28.

*Primary Examiner*—Douglas W. Olms
*Attorney, Agent, or Firm*—W. J. Streeter; T. A. Briody; J. E. Barbee

[57] ABSTRACT

A four channel stereophonic sound system requiring only two transmission channels and two audio amplifiers is disclosed wherein two different linear combinations of all four original discrete signals are recorded or transmitted, amplified and subsequently decoded in a passive network interconnecting the four output speaker system.

3 Claims, 5 Drawing Figures

INVENTORS
RONALD O. BARBER
DANIEL J. BARNES
BY Jeffers and Rickert
ATTORNEYS

INVENTORS
RONALD O. BARBER
DANIEL J. BARNES

BY Jeffers and Rickert
ATTORNEYS

COMPATIBLE 4-2-4 ENCODING-DECODING SYSTEM

RELATED APPLICATIONS

This is a continuation of copending application Ser. No. 181,847, filed Sept. 20, 1971, entitled Compatible 4-2-4 Encoding-Decoding System of inventors Ronald O. Barber and Daniel J. Barnes, which application is assigned to the same assignee as the present application.

BACKGROUND OF THE INVENTION

The present invention relates to four channel stereophonic sound equipment and more especially to such four channel equipment of the "matrix" type.

In a concert hall, a listener receives sounds from, for example, an orchestra directly and additionally receives sounds reflected from the walls, ceiling and other structures within the concert hall. The first step in attempting to reproduce the concert hall environment in a realistic manner was to record or transmit two separate sound channels representing respectively the sounds coming from the left and right sides of the concert hall stage. This system is fairly realistic in its sound reproduction, however, there have been recent attempts to provide audio systems having more than two channels so as to provide a listener with an even more realistic sound reproduction. These recent attempts have typically been four channel systems using one of two very different approaches.

One approach to providing a four channel stereophonic sound system is to simply add two additional channels to existing two channel stereophonic schemes. In the well known two channel stereophonic systems, the outputs of two physically separated microphones are recorded on two independent tracks in a tape recorder or analogously transmitted or recorded on a long playing record, and subsequently each independent track or channel is amplified and the signal to two physically separated speakers to recreate the original sound environment. It is clearly possible to provide for example, a four channel tape recorder and using four physically separated microphones to record their individual responses and subsequently using four separate amplifiers and speaker systems to reproduce in a four channel manner, the original sound environment. This approach is called "discrete" four channel stereo and while it gives extremely realistic sound reproduction, it is quite costly and plagued with numerous technical problems. For example, it is well established procedure to record two distinct channels on a phonograph record, however, no satisfactory system for recording four distinct channels on such records has yet been established. A discrete four channel stereo system requires four separate audio amplifiers and of course the existing allocation of radio frequencies renders four channel radio transmission difficult and costly.

Another approach to providing four channel stereophonic sound, known as the matrix approach, begins with the four different electronic signals from four separated microphones but mixes these four signals so as to provide just two channels of information for recording or transmission. The two thus mixed channels are of course quite compatible with existing equipment and readily recorded or transmitted. These two mixed channels are subsequently decoded in some manner to approximately reproduce the original four channels of information. Known accurate decoding techniques require four audio amplifiers in the reproduction equipment since the decoding is performed prior to power amplification.

In contradistinction, the present invention provides a matrix type four channel stereophonic sound system requiring only two audio amplifiers and effects the decoding subsequent to amplification in a passive network at the terminals of the four speakers.

SUMMARY OF THE INVENTION

In accordance with the present invention, four discrete signals are encoded for two channel storage or transmission by forming a pair of different linear combinations of all four channel signals. These two linear combinations or composite signals are then transmitted or recorded in accordance with the known prior art techniques for two channel stereo sound systems and subsequently amplified and supplied to the passive decoding network of the present invention. This decoding network requires no active circuit elements and has two input terminals and a common terminal thus forming two input channels. The network is interconnected with at least four transducers for converting electrical energy into sound energy and each transducer is at least indirectly coupled to both of the input terminals. The decoder operates on the principle that when the same signal is introduced in phase into both channels a first pair of the transducers or speakers are energized to a greater extent than the second pair whereas if these same signals are simultaneously introduced into both channels in an out of phase manner, the second pair of speakers will be energized to a greater extent than the first pair. The apparatus and method according to the teachings of the present invention provide a four channel stereophonic system having separation qualities which are difficult to distinguish from the separation qualities of far more expensive four channel stereo systems.

Accordingly, one object of the present invention is to provide a four channel stereo system which is compatible with two channel stereo systems.

Another object of the present invention is to provide a method and apparatus for simulating a discrete four channel stereo sound system.

A further object of the present invention is to provide an inexpensive multiple channel stereo sound system.

A still further object of the present invention is to provide a method and apparatus for encoding *n* distinct signals for transmission or recording on m transmission channels and at least approximately reconstructing the n distinct signals after transmission where n is a natural number greater than m.

Yet another object of the present invention is to provide an improved multiple channel sound system.

These and other objects and advantages of the present invention will appear more clearly from the following detailed disclosure read in conjunction with the accompanying drawings in which:

DESCRIPTION OF THE PREFERRED EMBODIMENT

Figure 1:
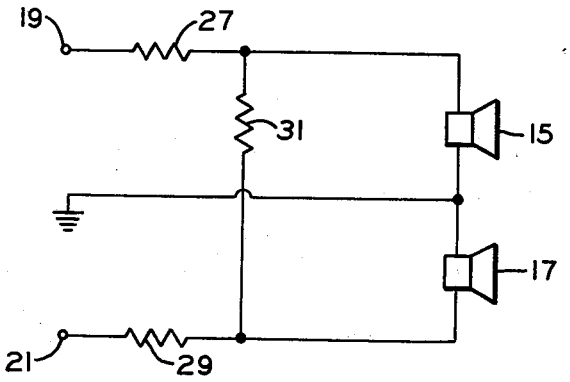
FIG. 1 is a schematic diagram of a portion of the decoder of the present invention.

The present invention is most easily understood by starting at the output and working backward through the system. The output as represented in FIGS. 3 and 4 consists of at least four transducers or speakers interconnected by a passive network of resistors and its operation is most easily understood from a somewhat fragmented analysis based on FIGS. 1 and 2. Consider first FIG. 2, which shows two speakers 11 and 13 connected in series between input terminals 19 and 21 and having their common point connected to ground by way of resistor 23 so as to form two input channels between the respective input terminals and ground. Assume that identical audio frequency signals are being presented in phase to the two input channels. Under these circumstances, the potential difference existing between points 19 and 21 will always be zero and for any energy delivered to the speakers some energy must be consumed in the resistor 23. The amount of separation between and energy delivered to the respective speakers is dependent on the value of resistor 23. On the other hand, assume that the two incoming signals are 180° out of phase so that the potential at terminal 21 is always the negative of the potential at terminal 19. Under this situation, if the speaker resistances are approximately equal, the potential at point 25 will be zero and no power will be consumed by the resistor 23. Thus, the audio output of the circuit of FIG. 2 is high for identical out of phase input signals and low for identical in phase input signals, the relative magnitudes being dependent upon the specific resistive values employed.

FIG. 1 similarly illustrates two transducers for converting electrical energy into sound energy such as speakers 15 and 17. The point common to the two speakers 15 and 17 is directly connected to ground which forms a common input terminal for two channels, the other input terminals of which are again labeled 19 and 21. The speakers 15 and 17 in conjunction with resistors 27 and 29 form a series circuit between the two input terminals 19 and 21 and the series combination of the two speakers 15 and 17 is shunted by yet another resistor 31. Taking the same hypothetical input situations which were analyzed with respect to FIG. 2 will show that the speakers of FIG. 1 behave in a manner precisely opposite to the behavior of the speakers of FIG. 2. Assume identical input signals are being applied to the two channels of FIG. 1 in phase with one another. Under these circumstances, the voltage between terminals 19 and 21 will be zero and, assuming equal values for the resistors 27 and 29 as well as matched speakers 15 and 17, the voltage across resistor 31 will be zero. Under this assumed in phase input situation no power is consumed in the resistor 31. On the other hand, if the two input channel signals are 180° out of phase, the potential at terminal 21 will be the negative of that at terminal 19 and appreciable current will flow through the resistor 31. Resistor 31 is effectively a phase discriminating resistance in parallel with the series connected transducers. Under this out of phase situation, power is consumed not only in resistor 31 but resistors 27 and 29 now have higher currents and thus greater power loss than for the in phase situation. Thus, the circuit of FIG. 1 provides higher output signals when the input channels are in phase.

Figure 2:
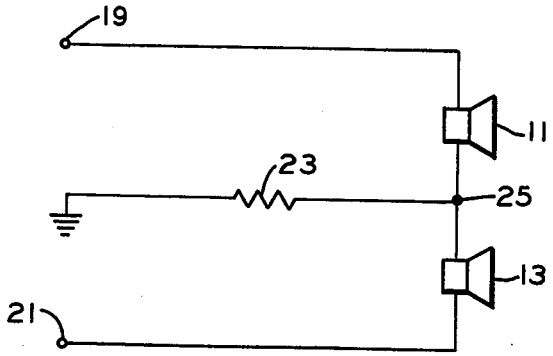
FIG. 2 is a schematic diagram of another portion of the decoder of the present invention.
Figure 3:
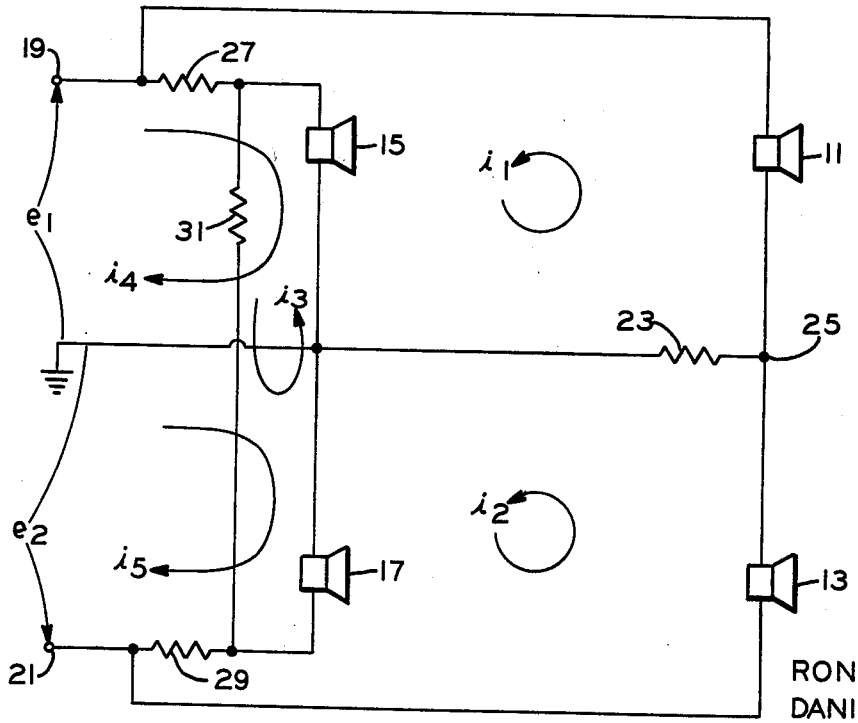
FIG. 3 is a complete schematic diagram of the decoder of the present invention.
Figure 4:
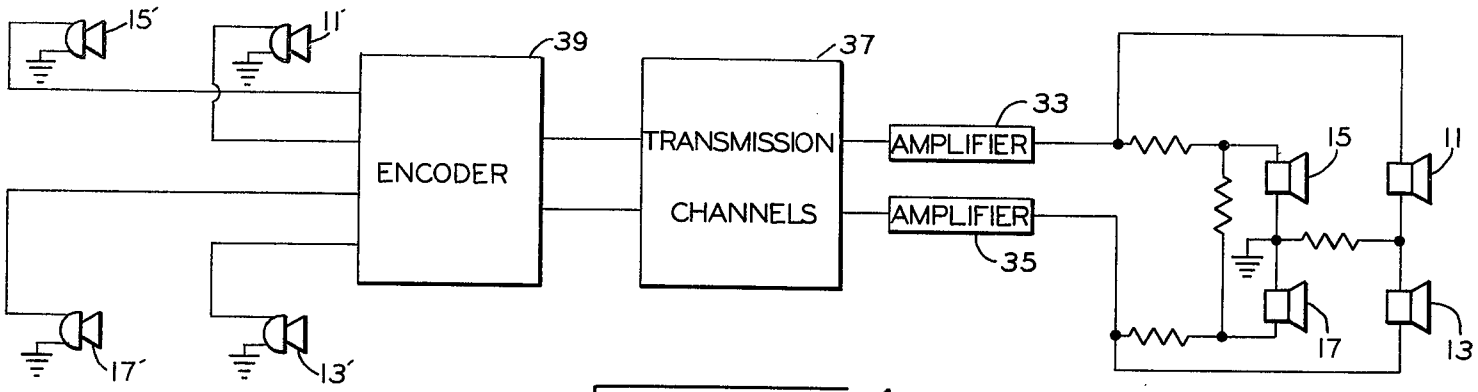
FIG. 4 is a partially schematic block diagram illustrating the overall system of the present invention.

FIG. 3 illustrates a combination of the circuits of FIGS. 1 and 2 where of course, like reference numerals indicate corresponding elements from FIGS. 1 and 2. The foregoing fragmented analysis of the operation carries over to FIG. 3 if we assume a low impedance source of signals for the two channels. Such an ideal voltage source assumption is not unreasonable with many of the present day transistor amplifier circuits.

The circuit of FIG. 3 is seen to have its input terminal 19 directly coupled to only the transducer 11 while the other transducers are indirectly coupled to this input terminal. Similarly, the input terminal 21 is directly coupled to the transducer 13 but indirectly coupled to the remaining transducers. Throughout the discussion direct coupling is used to indicate there is no intentionally introduced circuit element between the elements whch are referred to as being directly coupled. Thus, while the wire interconnects transducers 15 and 17 does have some resistance, there is no intentionally introduced circuit element between these two transducers and they are said to be directly coupled to the common input terminal or ground.

If identical and in phase signals are presented to both input channels of FIG. 3, no current flows in resistor 31 and the outputs of transducers 15 and 17 are relatively high while current flow through transducers 11 and 13 is limited by resistor 23 and the outputs of transducers 11 and 13 are relatively low. Under the other earlier assumption of identical signals which are 180° out of phase with one another, the potential at point 25 is zero and there is no current flow in resistor 23 thus giving a relatively high output from the transducers 11 and 13, however, there is substantial current flow in the resistor 31 causing voltage drops across resistors 27 and 29 thus giving relatively lower outputs from the transducers 15 and 17.

To carry the analysis of the circuit of FIG. 3 a bit further, suppose that only the lower channel is being supplied with a single audio signal, in other words, that the signal is applied between terminal 21 and ground. Under these circumstances, speakers 17 and 13 will be relatively louder than speakers 15 and 11. If a percentage of that signal is also applied to the upper channel in phase (so that terminals 19 and 21 are either both positive going or both negative going at the same time) the level of speaker 13 will decrease and that of speaker 15 will increase. If we represent the signal input to the lower channel as $S_1$ then this percentage applied to the upper channel in phase may be represented as $KS_1$ where K is a real number between zero and 1. As the percentage is increased (K is allowed to become larger) a point is reached where the level of speakers 15 and 13 are equal but somewhat below that of speaker 17. Under these circumstances, the remaining speaker 11 is down in level a great deal below the level of speaker 17 and is lower than the level of the speakers 13 and 15. Assuming that the four speakers were for example, disposed in the four corners of a room, a listener in the room would identify the source of the sound as being at speaker 17. Suppose now that a percentage of the signal being supplied to the lower channel is also supplied to the upper channel but 180° out of phase with the lower channel signal. As this percentage is increased, a point will be reached where the level of speakers 17 and 11 are equal and each is less than the level of speaker 13 under which circumstances speaker 13 will appear to a listener as being the source of the sound. Thus, to make an upper speaker of FIG. 3 the apparent source, a signal is fed to the upper channel and a fraction thereof supplied to the lower channel whereas one of the two lower speakers as viewed in FIG. 3 may be made the apparent source by supplying the main signal to the lower channel and a fraction thereof to the upper channel. To make one of the two speakers to the right the apparent source, this input signal and the fraction thereof should be out of phase whereas to make one of the left speakers of FIG. 3 the apparent source the two signals should be in phase.

Turning now to FIG. 4, the inputs to terminals 19 and 21 are derived respectively from audio amplifiers 33 and 35 which in turn receive their signals from what are here generically termed transmission channels. The transmission channels 37 may be a plural channel magnetic tape recording, radio transmissions, or any other system for either recording or transmitting a plurality of audio frequency signals. The transmission channels in turn receive their signals from an encoder 39, the details of which are set forth in FIG. 5. The input to this encoder is a plurality of sources of discrete channel signals and may be a series of transducers for converting sound energy into electrical energy such as common microphones. In the normal recording or studio transmitting situation, these four microphones would be distributed about the studio or concert hall in generally the same configuration as the speakers would be distributed about the listener's room. The correspondence between a given input microphone and its corresponding output speaker has been illustrated in FIG. 4 by using primed corresponding reference numerals, thus, if the originating sound source were extremely close to microphone 17' the listener would identify the speaker 17 as being the source of the sound. Before tracing a signal completely through the system, some consideration needs to be given to the encoder 39 which is illustrated in detail in FIG. 5.

Figure 5:
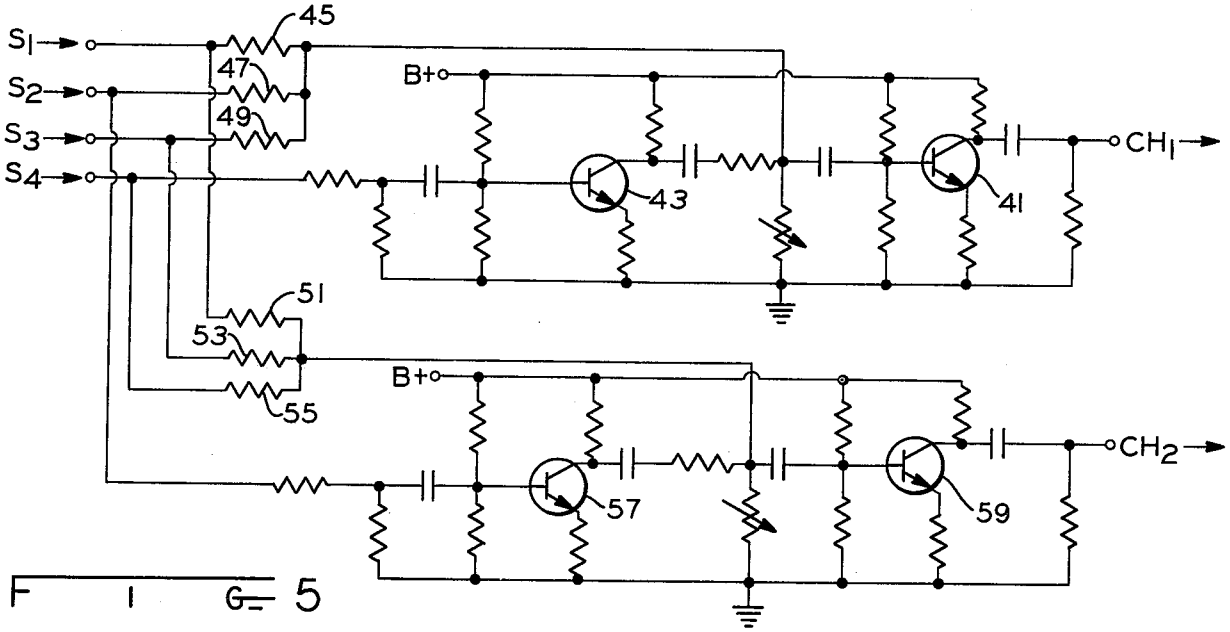
FIG. 5 is a schematic diagram of one possible encoder for FIG. 4.

FIG. 5 illustrates in essence a pair of two stage amplifiers which receive the same inputs but those inputs are supplied to the amplifiers in different manners. Each of the amplifiers has two stages of transistor amplification and each of the transistors is connected in a common emitter configuration and gives a 180° phase shift between its input and its output. The specific amplifier stage configuration shown is only one of many which could be utilized in the practice of the present invention and will not be discussed in any detail. The significant feature of FIG. 5 is the manner in which the inputs are supplied to the amplifier stages.

Considering first the input to the second stage of the upper amplifier of FIG. 5 as represented by the transistor 41, this input is seen to be the output of the first stage of the amplifier as represented by the transistor 43 along with a linear combination of the signals S1, S2, and S3 as supplied by way of the resistors 45, 47 and 49. Transistor 43 receives the signal S4 and amplifies it as well as providing it with a 180° phase shift and thus the input to transistor 41 is S1, S2, S3 and the negative of S4 with each signal having an appropriate scale factor as determined by the resistances and the gain of stage 43. Stage 41, of course, provides a 180° phase shift to each of the signals, however, that phase shift is quite immaterial for the purposes of the present invention and may be ignored or the stage so designed that no phase shift occurs. In practice, good results were attained by taking the resistances 45 and 47 as being equal while resistor 49 is larger than either of these resistors. The gain of stage 43 has been selected so that S4 is presented to the second stage input at a level similar to S3 and both of these are below the input levels of S1 and S2. Thus, the output of channel 1 may be represented as follows:

$$CH_1 = K_1S_1 + K_2S_2 + K_3S_3 - K_4S_4$$

where $K_1$ through $K_4$ are real numbers, not necessarily distinct, between zero and one. The lower two stage amplifier of FIG. 5 functions in precisely the same manner but receives a permutation of the same four signals applied to the upper stage. The resistors 53 and 55 may be set equal and resistor 51 is greater while signal $S_2$ is now the one experiencing a 180° phase shift in the first stage as represented by transistor 57. Thus, the output of the lower amplifier may be represented as:

$$CH_2 = K_5S_1 - K_6S_2 + K_7S_3 + K_8S_4,$$

and here again $K_5$ through $K_8$ are real numbers, not necessarily distinct, between zero and one. In one preferred embodiment, the gains of stages 43 and 57 and the resistances of the resistors 49 and 51 were so selected that $K_1 = K_2 = K_7 = K_8 = 1$, $K_3 = K_4 = K_5 = K_6 = K$ Under the last simplifying assumption, the input $e_1$ to terminal 19 of FIG. 3 relative to the ground terminal would be proportional to $S_1 + S_2 + KS_2 - KS_4$ while the input $e_2$ to terminal 21 relative to ground would be proportional to $KS_1 - KS_2 + S_3 + S_4$. The phase shifts introduced by the transistor stages 41 and 59 may for example have been compensated for by a similar phase shift in the amplifiers 33 and 35 however, the relative phasing between these inputs to terminals 19 and 21 is the only factor of concern.

It was earlier established that the circuit of FIG. 3 was capable of making one of its speakers the apparent source of a sound according to the phasing of the two input channel signals. That this circuit provides the desired four channel stereo effect and is compatible with the encoder of FIG. 5 may be seen from some rather unsavory but straightforward algebra. Assuming loop currents $i_1$ through $i_5$ as illustrated in FIG. 3 and assuming input channel signals $e_1$ and $e_2$ as shown, the following five equations may be written:

$$e_1 = R_{27}(i_1 + i_4) + R_{15}(i_1 + i_4 - i_3) \quad (1)$$

$$e_2 = -R_{29}(i_2 + i_5) + R_{17}(i_3 - i_2 - i_5) \quad (2)$$

$$e_1 - e_2 = R_{27}(i_1 + i_4) + R_{31}i_3 + R_{29}(i_5 + i_2) \quad (3)$$

$$e_1 = -R_{11}i_1 + R_{23}(i_2 - i_1) \quad (4)$$

$$e_2 = R_{13}i_2 + R_{23}(i_2 - i_1).$$

Fortunately, the last two of these equations form an independent subsystem of two equations in two inknowns (for the same reasons that allowed the circuit to be split up into FIGS. 1 and 2 for the earlier analysis) and may be readily solved for $i_1$ and $i_2$. The expression for $i_2$, the current through speaker 13 is:

$$(6) \qquad i_2 = \frac{R_{23}e_1 - (R_{11} + R_{23})e_2}{R_{23}^2 - (R_{11} + R_{23})(R_{13} + R_{23})}$$

From this equation, the relative levels of current and power (proportional to the square of the current) may be easily calculated for situations where only one of the input transducers is energized. Thus, assuming in turn equal magnitude input signals to each of the four input microphones 11', 13', 15' and 17' respectively and assuming several different values for the several resistances of FIG. 3, the following results may be obtained:

| Case I<br>$R_{11} = R_{13} = 8$ ohms;<br>$R_{23} = 15$ ohms; K = .42 | | | Case II<br>$R_{11} = R_{13} = R_{23} = 8$ ohms;<br>K = .42 | |
|---|---|---|---|---|
| Microphone Source | Speaker 13 Current | Speaker 13 Power | Speaker 13 Current | Speaker 13 Power |
| 11' | .81 | 5.240 | .81 | 5.240 |
| 13' | .97 | 7.52 | 1.0 | 8.0 |
| 15' | .18 | .256 | .0025 | .0000 |
| 17' | .55 | 2.40 | 1.0 | 8.0 |

| Case III<br>$R_{11} = R_{13} = 8$ ohms;<br>$R_{23} = 20$ ohms; K = .42 | | | Case IV<br>$R_{11} = R_{13} = 8$ ohms<br>$R_{23} = 10$ ohms; K = .42 | |
|---|---|---|---|---|
| Microphone Source | Speaker 13 Current | Speaker 13 Power | Speaker 13 Current | Speaker 13 Power |
| 11' | .83 | 5.52 | .62 | 3.04 |
| 13' | .95 | 7.20 | 1.0 | 8.0 |
| 15' | .21 | .352 | .11 | .096 |
| 17' | .51 | 2.08 | .62 | 3.04 |

In this analysis we have presumed that the gains and input signal levels are such that $e_1$ and $e_2$ have magnitudes of either 10 volts or 4.2 volts.

From the foregoing tabulation, it is easily seen that speaker 13 is most strongly energized when its corresponding microphone 13' is the one receiving the input signal, however, the degree of separation is quite variable depending upon the resistance values employed. For the assumed values, case IV obviously gives the best separation and speaker 13 is readily identifiable as being the source, however, no claim is made that the particular parameters employed in Case IV are optimum and different values might well be desirable depending upon a specific installation or an overall optimization of the system including acoustical considerations.

The value of K, of course, may be varied by varying the encoder parameters and it may, in some instances, be desirable to use potentiometers in conjunction with or in place of some of the resistors which interconnect the speakers in order to balance the system for a specific installation. In some instances it may also be desirable to diminish the separation possible between the rear speakers in favor of more separation between the front and rear speakers and, between the left front speaker and the right front speaker. In one specific embodiment constructed according to the teachings of the present invention, this was done by raising the value of R23 and using the following specific impedance values: $R_{27}$ and $R_{29} = 2$ ohms, $R_{31} = 8$ ohms, $R_{23} = 33$ ohms, all four speakers = 8 ohms. Such values aided the realistic effect, for example, when using monaural recordings or stereo recordings having identical information on both channels, such for example, as a center stage soloist, so as to make it more easy to identify a front center source of the sound. This, of course, is a compromise which results in less separation between the two rear speakers.

As analysis similar to the foregoing may be made for the other speakers under varying input conditions and among other things, it may be shown that the present invention is completely compatible with existing two channel stereo systems. For two channel operations, speakers 15 and 11 would correspond to, for example, the right channel whereas the speakers 17 and 13 would correspond to the left channel. The separation for either two or four channel operation is of course not perfect and some of the signal from one of the channels will appear in the other output channel, however, the practical effect of this intermingling is not detrimental from a listener's point of view and a four channel system employing only two transmission channels and compatible with two channel stereo recordings or transmission may be easily constructed by one of ordinary skill in the art in light of the foregoing disclosure.

Numerous modifications will readily suggest themselves to those of ordinary skill in the art, for example, the circuit of FIG. 3 may be used as an encoder by substituting microphones or other input sources for the speakers and appropriately rescaling the resistance values in line with the impedances of the input sources and of course selecting circuitry to be energized by such a FIG. 3 encoder having an appropriate input impedance. It should also be obvious to one or ordinary skill in the art that in using a stereo system built in accordance with the present invention some experimentation in the appropriate positioning of the speakers in a given installation as well as the relative phasing of those speakers will be desirable in order to achieve optimum performance. The relative phasing of a given speaker is of course changed by merely interchanging the speaker leads. Accordingly, the scope of the present invention is to be measured only by that of the appended claims.

We claim:

1. A passive decoding network for decoding two channel stereo signals into four channel signals comprising:

first, second, and third input terminals for receiving a first channel signal between the first and third input terminals and a second channel signal between the second and third input terminals;

a plurality of output terminals for delivering output signals to transducers; second of said terminals coupled a first of said output terminals directly coupled to the first input terminal, a second output terminals directly coupled to the second input terminal, and a third of said output coopled to the third input terminal through a first impedance means;

a fourth of said output terminals connected to the first input terminal through a second impedance means, a fifth of said output terminals coupled to the second input terminal through a third impedance means, and a sixth of said output terminals directly coupled to the third input terminal; and a fourth impedance means connected between the fourth and fifth of said output terminals.

2. The passive decoding network of claim 1 further comprising four transducers for converting electrical energy into sound energy and wherein a first transducer is connected between the first and third output terminals, a second transducer is connected between the second and third output terminals, a third transducer is connected between the fourth and sixth output terminals, and a fourth transducer is connected between the fifth and sixth output terminals.

3. The invention according to claim 1 wherein each of said impedances is a resistance.

* * * * *